United States Patent [19]

Baldwin

[11] 4,323,139

[45] Apr. 6, 1982

[54] ENERGY SAVING EXHAUST SIPHON

[76] Inventor: Nealy B. Baldwin, 8915 University Blvd., North Charleston, S.C. 29405

[21] Appl. No.: 192,919

[22] Filed: Oct. 1, 1980

[51] Int. Cl.[3] ..... F01N 1/14

[52] U.S. Cl. ..... 181/263; 181/243; 60/319

[58] Field of Search ..... 181/211, 212, 227, 228, 181/241, 243, 259, 262, 263, 282, 283; 60/317, 319

[56] References Cited

U.S. PATENT DOCUMENTS

| | | | |
|---|---|---|---|
| 1,027,469 | 5/1912 | Forney | 181/263 |
| 1,217,615 | 2/1917 | McDowell | 181/262 |
| 1,794,276 | 2/1931 | Bowes | 181/262 |
| 1,864,915 | 6/1932 | Kosterman | 181/262 |
| 1,966,620 | 7/1934 | Fluor, Jr. | 181/262 |
| 2,162,683 | 6/1939 | Tobin | 181/262 |
| 3,043,097 | 7/1962 | Inman et al. | 181/262 X |
| 3,857,458 | 12/1974 | Ohtani et al. | 181/262 |

*Primary Examiner*—L. T. Hix
*Assistant Examiner*—Benjamin R. Fuller
*Attorney, Agent, or Firm*—Larry Harold Kline

[57] ABSTRACT

A device is disclosed for attachment to the tailpipe of an exhaust system comprising a body portion placed around the tailpipe, but spaced apart from the tailpipe, in a manner that air may easily flow between the body portion and the tailpipe when the vehicle is moving in a forward direction, a narrowing portion operative to compress the air flow, and an exhaust discharge portion operative for the exhaust from the tailpipe and the air to be discharged therethrough.

7 Claims, 6 Drawing Figures

ENERGY SAVING EXHAUST SIPHON

This invention relates to an energy conservation device and more particularly to a method of conserving energy in vehicles with an exhaust system.

The invention is basically an exhaust siphon which is attached to the end of the tailpipe of an internal combustion engine. The exhaust siphon begins to work when the vehicle is placed into motion and depends on the forward motion of the vehicle to collect the necessary air to function. A partial vacuum is created to aid in removing the exhaust from the internal combustion engine. Back pressure is relieved on the engine, allowing the engine to perform more efficiently and, thereby saving fuel.

An object of the present invention is to provide a device for attachment to the tailpipe of an internal combustion engine's exhaust system to create a partial vacuum to aid in removing the exhaust more efficiently.

Another object of the present invention is to provide a device which can easily be attached to the tailpipe of an internal combustion engine's exhaust system without the necessity of great expertise, and which functions to aid the efficiency of the exhaust system and, thereby saving energy.

Still another object of the present invention is to provide a device for attachment to the tailpipe of an internal combustion engine's exhaust system which has mounting means as part of the device.

Still another object of the present invention is to provide an alignment guide as part of a device to aid in attaching the device to the tailpipe.

These and other objects and features of the invention will be apparent from the following description and appended claims.

Briefly, the invention is a device for attachment to the tailpipe of an exhaust system of a vehicle. The device has a body portion which is placed around the tailpipe, but spaced apart from the tailpipe in a manner that air may easily flow between the body portion and the tailpipe when the vehicle is moving. A narrowing portion is secured to the body portion and is located in the area of the outer end of the tailpipe. The narrowing portion is operative to compress the air flowing between the tailpipe and the body portion when the vehicle is moving. An exhaust discharge portion is connected to the narrowing portion and is operative for the exhaust from the tailpipe and the air to be discharged therethrough. A flared portion is connected to the body portion on the opposite side from the narrowing portion. The flared portion has a circumference equal to the body portion at one end, and a circumference larger than the circumference of the body portion at the end furtherest away from the body portion. The flared portion aids in the flow of the air when the vehicle is moving. Mounting means is adjustably secured to the other surface of the body portion. A removable alignment guide is secured around the tailpipe and within the flared portion when the mounting means is utilized to secure the device onto the tailpipe. The removable alignment guide has a perforated portion which is removable to place the tailpipe through the removable alignment guide. The removable alignment guide has an opening to aid in the removal of the removable alignment guide. The mounting means comprises a plurality of adjustable alignment guide bolts, each of which extends through a rigidly secured guide nut. The plurality of adjustable alignment guide bolts may secure the device onto the tailpipe while centering the tailpipe within the body portion of the device. The mounting means may comprise a plurality of Allen-type set screws, each of which extends through a mechanically punched and threaded portion of the body portion. The mounting means may comprise a plurality of Allen-type set screws extending through a threaded portion of the body portion. The plurality of Allen-type set screws may secure the device onto the tailpipe while centering the tailpipe within the body portion of the device.

The invention will be more fully understood from the following detailed description and appended claims when taken with the drawings in which:

FIG. 1 is an isometric view of the device 1 secured to tailpipe 2 with temporary alignment guide 23 in place.

Figure 4:
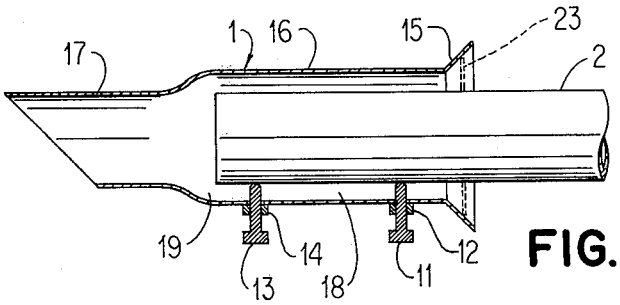

FIG. 4 is a longitudinal sectional view of device 1 secured into tailpipe 2 with temporary alignment guide 23 indicated in place.

Figure 5:
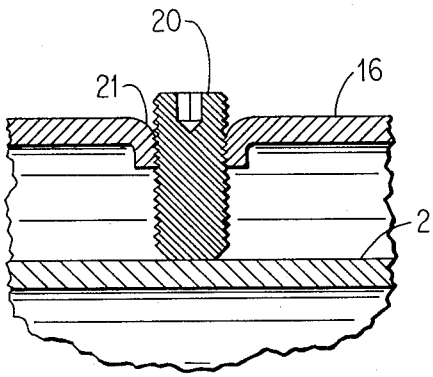

FIG. 5 is a partial sectional view of an alternate mounting means for mounting device 1 onto tailpipe 2.

Figure 6:
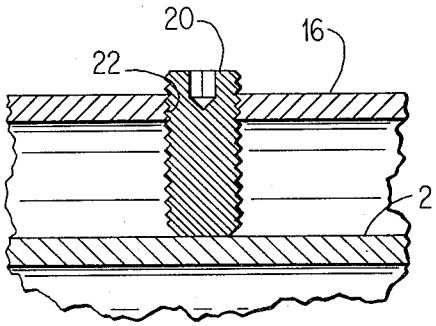

FIG. 6 is a partial sectional view of another mounting means for mounting device 1 onto tailpipe 2.

Figure 1:
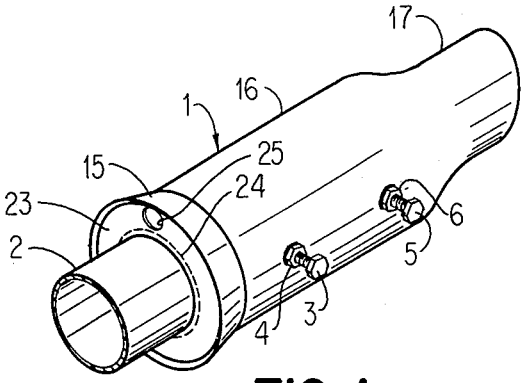

Referring now to the drawings, FIG. 1 is an isometric view of device 1 mounted onto tailpipe 2 shown from the air intake end of the device 1. The removable temporary alignment guide 23 may be made from any material desired. In placing device 1 onto tailpipe 2, the temporary alignment guide 23 is cut so that it fits snugly around tailpipe 2. The temporary alignment guide 23 is then placed onto tailpipe 2 sufficient distance to aid in the mounting of device 1 onto tailpipe 2. Temporary alignment guide 23 may have several perforated portions 24 in orderto accommodate the different diametered tailpipes. The necessary center section to be removed may be of different diameters for different tailpipes. When the device 1 is mounted, the temporary alignment guide 23 may be removed. One easy method of removal is to insert something in a hole, such as hole 25, to pull the temporary alignment guide 23 away from the device 1. The temporary alignment guide 23 is no longer necessary after device 1 has been mounted.

The device 1 has a body 16, a flared forward portion 15, and a discharge portion 17. A plurality of adjustable mounting means are secured to the device 1. Shown in the drawings are adjustable alignment guide bolts 3, 5, 7, 9, 11, and 13. Each adjustable alignment guide bolt has an alignment guide nut through which the adjustable alignment guide bolt is adjusted. Bolt 3 has nut 4, bolt 5 has nut 6, bolt 7 has nut 8, bolt 9 has nut 10, bolt 11 has nut 12, and bolt 13 has nut 14.

Figure 2:
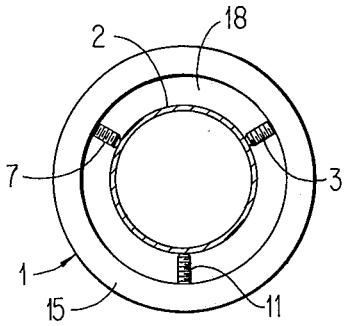
FIG. 2 is a front elevational view of the air intake end of device 1 secured onto tailpipe 2.

FIG. 2 is a front elevational view of device 1 secured onto tailpipe 2. FIG. 2 is taken from the air intake end of device 1. Device 1 is designed to fit around tailpipe 2 with a significant air passage space 18 between device 1 and tailpipe 2. Device 1 has a flared portion 15 which aids in allowing air to flow into the air passage space 18. Device 1 does not function until the vehicle begins to move in a forward motion. The forward motion of the vehicle causes air to flow into air passage space 18 and to rush forward through the air passage space 18 toward the discharge portion 17 of device 1. In FIG. 2, adjustable alignment guide bolts 3, 7, and 11 are seen secured into place and holding device 1 onto tailpipe 2 with a proper air passage space 18 around tailpipe 2 and inside of device 1.

Figure 3:
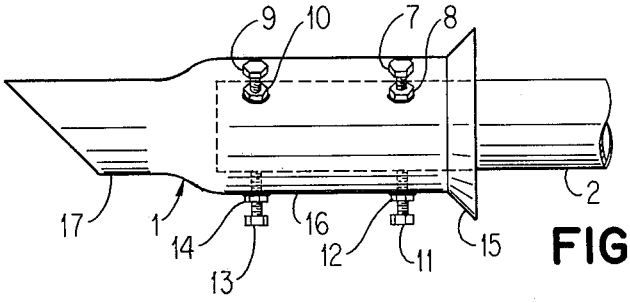
FIG. 3 is a side elevational view of device 1 secured onto tailpipe 2.

FIG. 3 is a side elevational view of device 1 secured onto tailpipe 2. The portion of tailpipe 2 secured within device 1 is shown in dotted lines. The air, which was shown in FIG. 2 passing through the air passage space 18, will pass around tailpipe 2 within device 1 and create a partial vacuum at the outer end of tailpipe 2, thereby creating a siphoning effect on the exhaust gases within the tailpipe 2. The siphoning effect lowers the back pressure on the exhaust system and, thereby lowers the amount of energy needed to operate the vehicle.

FIG. 4 is a longitudinal sectional view of device 1 secured onto tailpipe 2. Temporary alignment guide 23 is shown in place temporarily secured around tailpipe 2. The device 1 is an energy saving device which is easily mounted on not only new vehicles, but vehicles which are already in service. Device 1 is designed to be easily mounted by not only the skilled mechanic, but by a very unskilled person.

It is desirable for the tailpipe 2 to have a squared-off end. If the tailpipe 2 does not have a squared-off end, this can easily be accomplished by cutting the end of the present tailpipe with an appropriate tool. The temporary alignment guide 23 may then be cut or pressed out on the perforated portion 24 and secured around tailpipe 2. Depending on the size of the device 1 desired, simple directions tell the mounter how far down the tailpipe 2 the temporary alignment guide 23 should be placed. The device 1 will then be placed around tailpipe 2 with the flared portion 15 on temporary alignment guide 23. Device 1 will then be held at discharge portion 17 while alignment guide bolts 3, 5, 7, 9, 11, and 13 are adjusted to firmly hold device 1 onto the tailpipe 2.

Temporary alignment guide 23 provides a method for allowing the air passage space 18 around tailpipe 2 to be as symmetrical as possible all the way around the tailpipe 2. The temporary alignment guide 23 is then removed utilizing hole 25.

When the vehicle is moving in a forward motion, air rushes into the flared portion 15 of device 1 and through air passage space 18 around tailpipe 2. Device 1 narrows at portion 19 to compress the air which increases the velocity of the air traveling through device 1. A partial vacuum is created in portion 19 thereby creating the siphon effect which lowers the back pressure on the exhaust system and lowers the amount of energy needed to operate the vehicle.

FIG. 5 is a partial sectional view of an alternate mounting means for mounting device 1 onto tailpipe 2. FIG. 5 shows a area 21 which is a mechanically punched and threaded portion of body portion 16 of device 1. Area 21 will serve as a base for securing Allen-type set screw 20 in body portion 16 of device 1. The Allen-type set screw 20, along with a plurality of similar Allen-type set screws, would hold device 1 onto tailpipe 2. A plurality of mechanically punched and threaded portions 21 would hold a plurality of Allen-type set screws 20 in order to secure device 1 onto tailpipe 2.

FIG. 6 is a partial sectional view of another mounting means for mounting device 1 onto tailpipe 2. In FIG. 6, body portion 16 of device 1 has a threaded opening 22 through which the Allen-type set screw 20 extends and is secured. Body portion 16 would have a plurality of threaded openings 22 through which a plurality of Allen-type set screws 20 would extend and be secured in order to secure device 1 onto tailpipe 2. The primary difference between the methods of FIG. 5 and FIG. 6 is that in FIG. 5 the opening 21 is mechanically punched and threaded which may be physically stronger than the threaded opening 22 in FIG. 6. The choice may be simply that of the manufacturer. If body portion 16 is of sufficient thickness, then the threaded opening 22 may suffice. FIG. 5 and FIG. 6 show the use of Allen-type set screw 20 in place of the previously shown adjustable alignment guide bolts. These types of mounting means may be utilized along with any other type of mounting means desired.

The present invention provides a device which can be easily attached to the tailpipe of an internal combustion engine's exhaust system without the necessity of great expertise. This device creates a partial vacuum in the exhaust system of an internal combustion engine which functions to aid the efficiency of the exhaust system by removing the exhaust more efficiently, thereby saving energy. Mounting means and an alignment guide are provided which aid in attaching the device to the tailpipe.

The discharge portion 17 may be of any design and is shown cut off at an angle to help direct the exhaust gases and air in a downward direction.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device for attachment to the tailpipe of an exhaust system of a vehicle comprising:

a. a body portion adapted to be placed around said tailpipe, but spaced apart from said tailpipe, in a manner that air may easily flow between said body portion and said tailpipe when said vehicle is moving in a forward direction;

b. a narrowing portion secured to said body portion and adapted to be located in the area of the outer end of said tailpipe, said narrowing portion having a circumference equal to said body portion at one end and a circumference smaller than the circumference of said body portion at the end furtherest away from said body portion, whereby said air, flowing between said tailpipe and said body portion when said vehicle is moving in a forward direction, will be compressed;

c. an exhaust discharge portion connected to said narrowing portion and operative for the exhaust from said tailpipe and said air to be discharged therethrough;

d. a flared portion connected to said body portion on the side opposite from said narrowing portion, said flared portion having a circumference equal to said body portion at one end and a circumference larger than the circumference of said body portion at the end furtherest away from said body portion, whereby said flared portion aids in the flow of said air when said vehicle is moving in a forward direction; and e. mounting means adjustably secured into the outer surface of said body portion, and adapted to hold said body portion spaced apart from said tailpipe.

2. A device according to claim 1 further comprising a removable alignment guide which is secured around said tailpipe and within said flared portion when said mounting means is utilized to secure said device into said tailpipe.

3. A device according to claim 2 wherein said removable alignment guide has a perforated portion which is removable to place said tailpipe through said removable alignment guide.

4. A device according to claim 2 wherein said removable alignment guide has an opening to aid in the removal of said removable alignment guide.

5. A device according to claim 1 wherein said mounting means comprises a plurality of adjustable alignment guide bolts, each of which extends through a rigidly secured guide nut, whereby said plurality of adjustable alignment guide bolts may secure said device onto said tailpipe while centering said tailpipe within said body portion of said device.

6. A device according to claim 1 wherein said mounting means comprises a plurality of Allen-type set screws, each of which extends through a rigidly secured guide nut, whereby said plurality of Allen-type set screws may secure said device onto said tailpipe while centering said tailpipe within said body portion of said device.

7. A device according to claim 1 wherein said mounting means comprises a plurality of Allen-type set screws, each of which extends through a threaded portion of said body portion, whereby said plurality of Allen-type set screws may secure said device onto said tailpipe while centering said tailpipe within said body portion of said device.

* * * * *